US009280136B2

(12) United States Patent
Horikawa

(10) Patent No.: US 9,280,136 B2
(45) Date of Patent: Mar. 8, 2016

(54) PHOTOSENSITIVE CARTRIDGE HAVING LOCKING MEMBER, DEVELOPING CARTRIDGE ATTACHABLE TO PHOTOSENSITIVE CARTRIDGE HAVING LOCKING MEMBER, PROCESS CARTRIDGE HAVING LOCKING MEMBER, AND IMAGE FORMING APPARATUS HAVING LOCKING MEMBER

(71) Applicant: CANON KABUSHIKI KAISHA, Tokyo (JP)

(72) Inventor: Tadashi Horikawa, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/600,954

(22) Filed: Jan. 20, 2015

(65) Prior Publication Data

US 2015/0205257 A1 Jul. 23, 2015

(30) Foreign Application Priority Data

Jan. 21, 2014 (JP) ..... 2014-008933

(51) Int. Cl.
*G03G 21/18* (2006.01)

(52) U.S. Cl.
CPC ..... *G03G 21/1842* (2013.01)

(58) Field of Classification Search
CPC ..... G03G 21/1817; G03G 21/1821; G03G 21/1842; G03G 21/1867
USPC ..... 399/90, 113, 119
See application file for complete search history.

(56) References Cited

U.S. PATENT DOCUMENTS 7,742,720 B2 * 6/2010 Okabe et al. ..... 399/113
8,761,634 B2 * 6/2014 Mori et al. ..... 399/113
8,938,187 B2 * 1/2015 Fukamachi ..... 399/113

FOREIGN PATENT DOCUMENTS

JP 2013-50494 A 3/2013

* cited by examiner

*Primary Examiner* — William J Royer
(74) *Attorney, Agent, or Firm* — Canon USA, Inc. IP Division

(57) ABSTRACT

A photosensitive cartridge attachable to/detachable from a main body of an image forming apparatus includes a photosensitive member, an attachment unit configured to removably attach a developing cartridge including a developing member that develops a latent image formed on the photosensitive member to the photosensitive cartridge, and a locking member configured to prevent disengaging of the developing cartridge from the attachment unit when the developing cartridge is attached to the attachment unit, wherein the locking member comes into contact, when the photosensitive cartridge to which the developing cartridge has been attached is attached to the main body of the image forming apparatus, with a main body contact member provided to the main body and electrically connects the main body contact member and the developing cartridge.

20 Claims, 13 Drawing Sheets

PHOTOSENSITIVE CARTRIDGE HAVING LOCKING MEMBER, DEVELOPING CARTRIDGE ATTACHABLE TO PHOTOSENSITIVE CARTRIDGE HAVING LOCKING MEMBER, PROCESS CARTRIDGE HAVING LOCKING MEMBER, AND IMAGE FORMING APPARATUS HAVING LOCKING MEMBER

BACKGROUND

1. Field of the Invention

The present disclosure relates to a photosensitive cartridge attachable to/detachable from a main body of an image forming apparatus, a developing cartridge attachable to/detachable from the photosensitive cartridge, a process cartridge, and the image forming apparatus.

The image forming apparatus is for forming an image on a recording medium. Examples of the image forming apparatus include an electrophotographic copying machine, an electrophotographic printer (a light-emitting diode (LED) printer, a laser beam printer, or the like), an electrophotographic facsimile machine, and an electrophotographic word processor.

The photosensitive cartridge includes an electrophotographic photosensitive member, and is removably attached to the main body of the image forming apparatus. The developing cartridge includes a developing unit that develops a latent image formed on the photosensitive member, and is removably attached to the photosensitive cartridge. The process cartridge is the one in which the developing cartridge is removably attached to the photosensitive cartridge.

The recording medium on which an image is formed is, for example, a recording sheet or an overhead projector (OHP) sheet.

2. Description of the Related Art

Conventionally, the image forming apparatus has employed a process cartridge method in which an image bearing member serving as an electrophotographic photosensitive member and a process unit which operates on the image bearing member are integrated to be attachable to/detachable from the main body of the image forming apparatus. Since the process cartridge method enables a user to perform maintenance of the image forming apparatus by himself, operability can be improved.

The process unit which operates on the image bearing member includes a charging member, a cleaning member, and a developer bearing member (hereinafter, referred to as a "developing roller"). A process cartridge configured by integrating all of the image bearing member, the process unit, and a developer storage unit is referred to as an all-in-one method. There is also a method in which the image bearing member and the process unit are divided into a plurality of cartridges. As an example of such a method in which the image bearing member and the process unit are divided into a plurality of cartridges, Japanese Patent Application Laid-Open No. 2013-50494 discusses a method in which a cartridge is divided into a photosensitive cartridge integrating an image bearing member, a charging member, and a cleaning member and a developing cartridge integrating a developer bearing member and a developer storage unit. Among such configurations, there is a configuration in which the developing cartridge is attachable to/detachable from the photosensitive cartridge.

An example of attachment to/detachment from the image forming apparatus in the configuration in which the developing cartridge is attachable to/detachable from the photosensitive cartridge will be described. In a detached state from the image forming apparatus, the developing cartridge is attached to the photosensitive cartridge, and then attached to the mage forming apparatus in an integrated state. When the photosensitive cartridge or the developing cartridge reaches its life, the user takes out the process cartridge in which the photosensitive cartridge and the developing cartridge are in the integrated state. Then, the user replaces the cartridge that has reached its life with a new cartridge, and integrates the photosensitive cartridge and the developing cartridge again to attach them to the image forming apparatus.

When the user handles the process cartridge which is in the detached state from the image forming apparatus, the developing cartridge may fall off from the photosensitive cartridge. Thus, a locking member is provided to the photosensitive cartridge, and the developing cartridge is locked by the locking member to be prevented from falling off.

However, in a case where the locking member is provided to the photosensitive cartridge, the number of components increases, and costs consequently increase. The present invention is directed to a technique for providing the locking member having a function of electrically connecting an apparatus main body and a cartridge to reduce the number of components.

SUMMARY OF THE INVENTION

According to an aspect disclosed herein, a photosensitive cartridge attachable to/detachable from a main body of an image forming apparatus includes a photosensitive member, an attachment unit configured to removably attach a developing cartridge including a developing member that develops a latent image formed on the photosensitive member to the photosensitive cartridge, and a locking member configured to prevent disengaging of the developing cartridge from the attachment unit when the developing cartridge is attached to the attachment unit, wherein the locking member comes into contact, when the photosensitive cartridge to which the developing cartridge has been attached is attached to the main body of the image forming apparatus, with a main body contact member provided to the main body and electrically connects the main body contact member and the developing cartridge.

Further features and aspects of the present invention will become apparent from the following detailed description of exemplary embodiments with reference to the attached drawings.

DESCRIPTION OF THE EMBODIMENTS

An image forming apparatus using a process cartridge according to the present disclosure will be described with reference to the drawings.

[Overall Configuration of Image Forming Apparatus]

Figure 2:
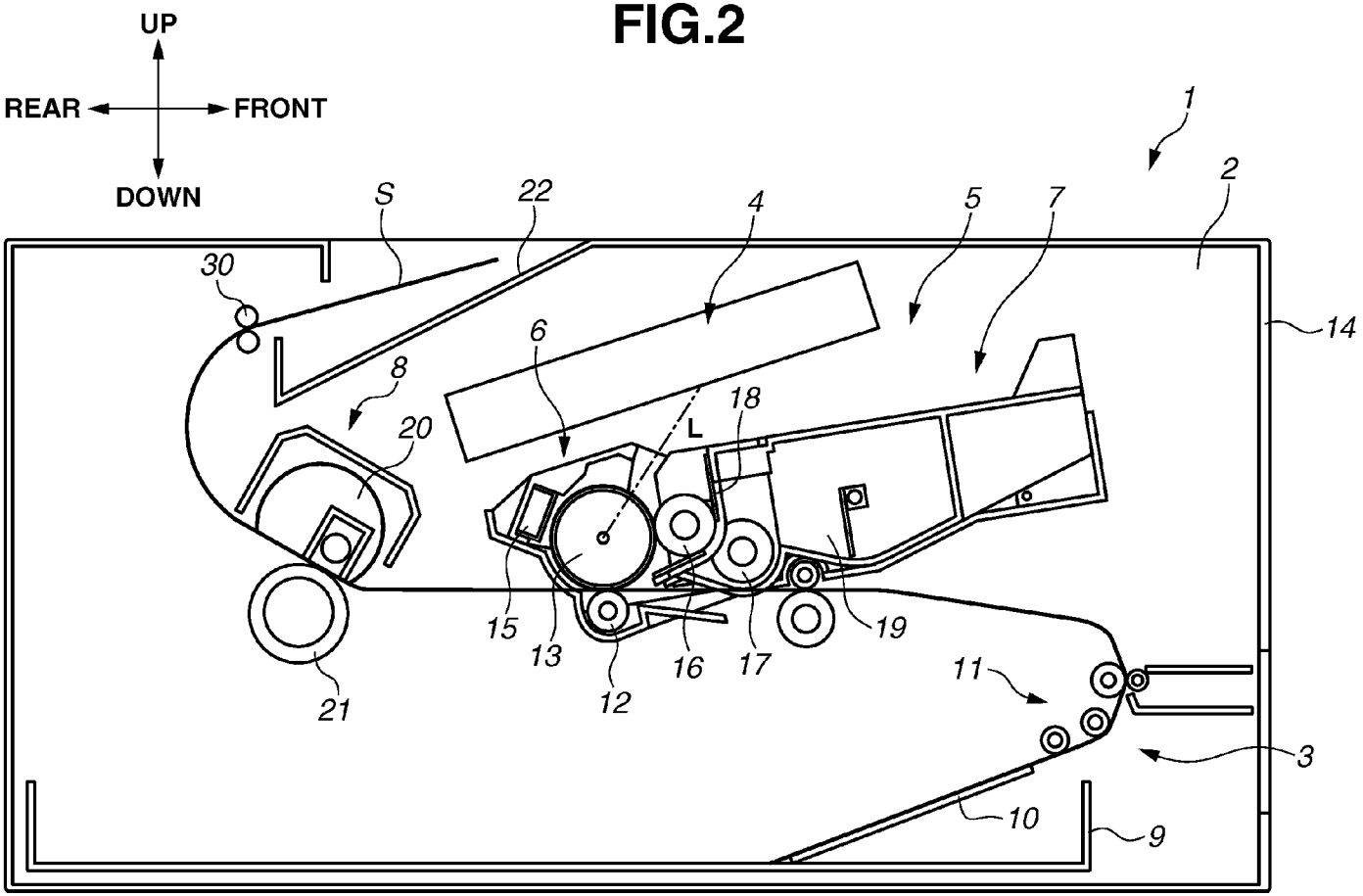
FIG. 2 is a sectional schematic view illustrating an outline of an electrophotographic image forming apparatus according to the exemplary embodiment.

An overall configuration of the image forming apparatus will be described referring to FIG. 2. FIG. 2 is a sectional schematic view illustrating an outline of an electrophotographic image forming apparatus.

The image forming apparatus will be described mainly from a user side who uses the image forming apparatus. In FIG. 2, a right side is "front", a left side is "rear", a front side is "left", a deep side is "right", and a vertical direction is "up and down".

As illustrated in FIG. 2, an image forming apparatus 1 includes a feeding unit 3, which feeds a recording medium S into an apparatus main body 2, an exposure device 4, a process cartridge 5, which transfers a developer image onto the recording medium S, and a fixing device 8, which thermally fixes the developer image transferred onto the recording medium S. The feeding unit 3 is disposed in a lower part of the apparatus main body 2, and includes a feed tray 9, a sheet pressing plate 10, and a sheet feeding mechanism 11. The recording medium S stored in the feed tray 9 is upwardly moved by the sheet pressing plate 10, and fed to between a photosensitive drum 13 and a transfer roller 12, which are arranged in the process cartridge 5, by the sheet feeding mechanism 11. The exposure device 4 is disposed in an upper part of the apparatus main body 2, and includes a laser emission unit, a scanning mirror, a lens, and a reflecting mirror. The exposure device 4 performs high-speed scanning of a surface of the photosensitive drum 13 with a laser beam L (indicated by a chain line illustrated in FIG. 2) based on image data emitted from the laser emission unit. The surface of the photosensitive drum 13 is accordingly exposed.

The process cartridge 5 is disposed below the exposure device 4, and configured to be detachably attached to the apparatus main body 2 through an opening opened when a front cover 14 provided to the apparatus main body 2 is opened. The process cartridge 5 includes a photosensitive cartridge 6 and a developing cartridge 7.

The photosensitive cartridge 6 includes the photosensitive drum 13, a charging member 15, and the transfer roller 12. The developing cartridge 7 is detachably attached to the photosensitive cartridge 6, and includes a developing roller (developing member) 16, a supply roller 17, a layer thickness regulation blade 18, and a developer storage unit 19.

[Detailed Configuration of Process Cartridge]

In the process cartridge 5, the surface of the photosensitive drum 13 is uniformly charged positive by the charging member 15, and then exposed by the high-speed scanning with the laser beam L from the exposure device 4. Accordingly, a potential at the exposed part is lowered to form an electrostatic latent image on the photosensitive drum 13 based on image data. A developer in the developer storage unit 19 is supplied to the developing roller 16 via the supply roller 17 and, at this point of time, is triboelectrically charged between the supply roller 17 and the developing roller 16. The developer supplied to the developing roller 16 enters between the layer thickness regulation blade 18 and the developing roller 16, and is more triboelectrically charged, so that the developer is born as a thin layer having a certain thickness on the developing roller 16.

The developer born on the developing roller 16 is supplied to the electrostatic latent image formed on the photosensitive drum 13. Accordingly, the electrostatic latent image is made visible, and a developer image is formed on the photosensitive drum 13. Then, the recording medium S is conveyed between the photosensitive drum 13 and the transfer roller 12, thereby the developer image on the photosensitive drum 13 is transferred to the recording medium S.

The fixing device 8 is disposed at a position rear of the process cartridge 5, and includes a heating unit 20 including a halogen heater, a fixing belt, and a nip plate, and a pressing roller 21 which holds the fixing belt between the pressing roller 21 and the nip plate of the heating unit 20. The fixing device 8 thermally fixes the developer image transferred onto the recording medium S during passage of the recording medium S between the heating unit 20 and the pressing roller 21. The recording medium S on which the developer image has been thermally fixed is discharged to an output tray 22 by a discharge roller 30. This completes the image forming process on the recording medium S.

[Detailed Configuration of Photosensitive Cartridge]

Figure 3:
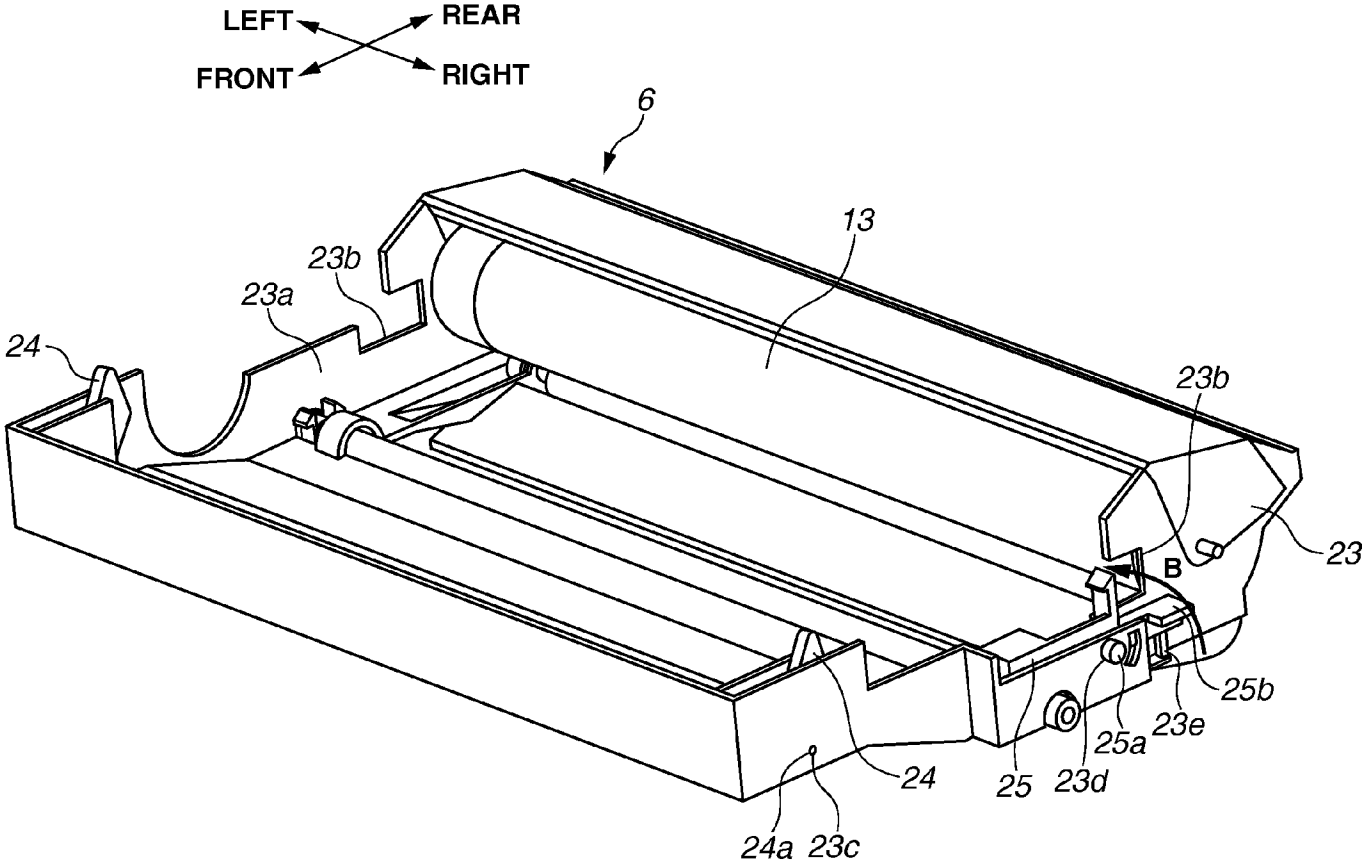
FIG. 3 is a perspective view illustrating a configuration of a photosensitive cartridge according to the exemplary embodiment.
Figure 4:
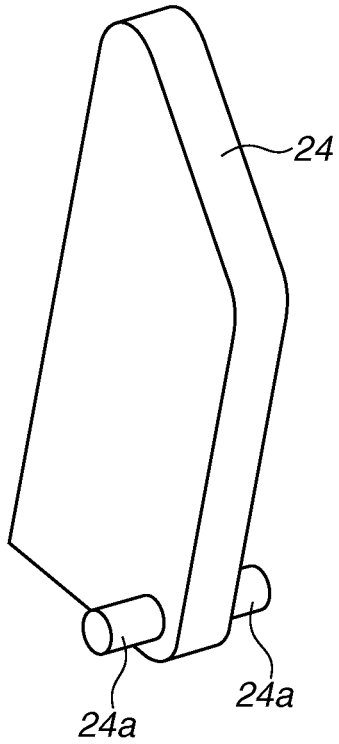
FIG. 4 is a perspective view illustrating a configuration of a pressing member according to the exemplary embodiment.
Figure 5:
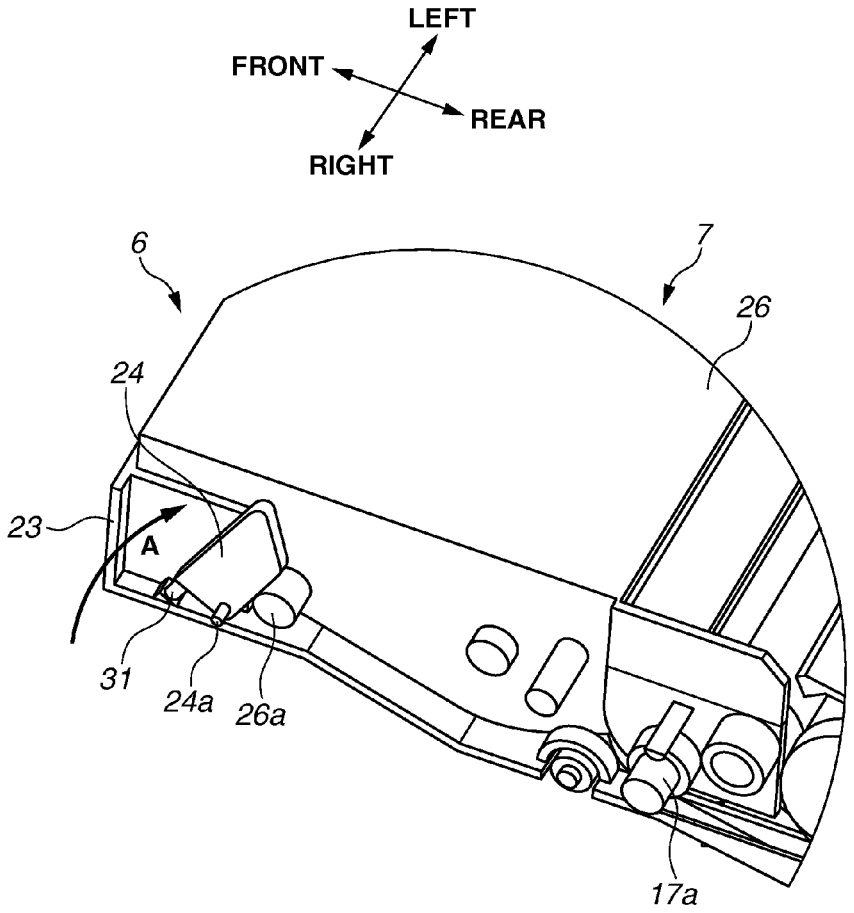
FIG. 5 is a perspective view illustrating the configuration of the pressing member according to the exemplary embodiment.
Figure 6:
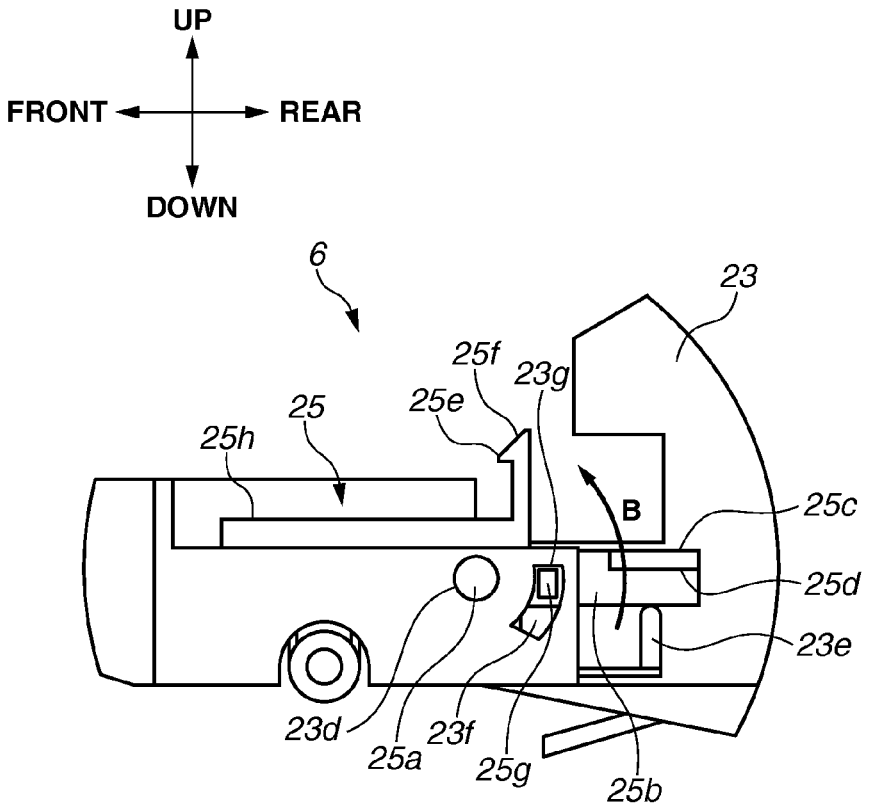
FIG. 6 is a side view illustrating the configuration of the locking member according to the exemplary embodiment.
Figure 7:
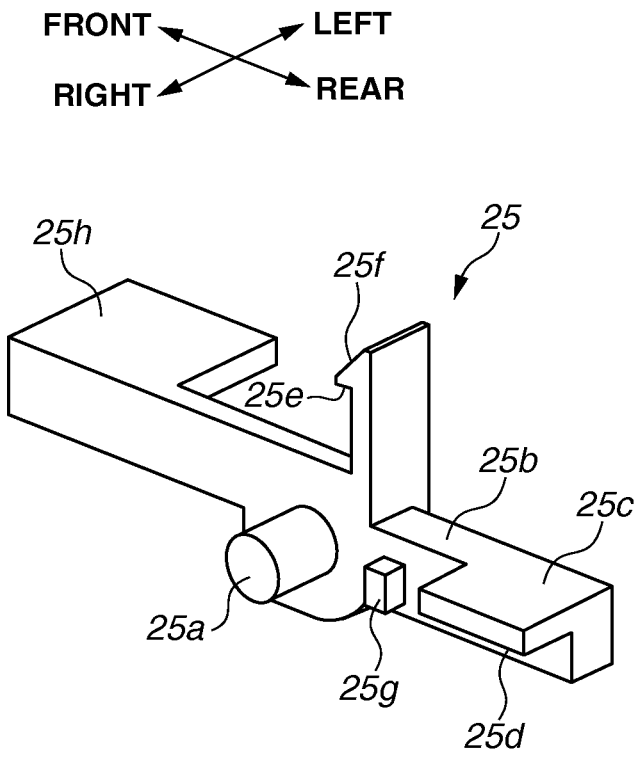
FIG. 7 is a perspective view illustrating a shape of the locking member (right side) according to the exemplary embodiment.
Figure 8:
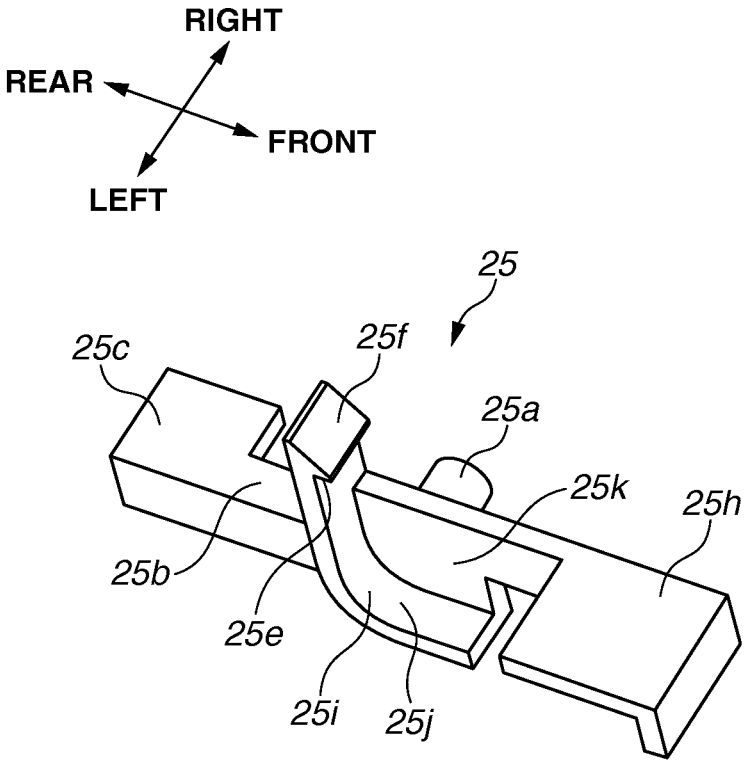
FIG. 8 is a perspective view illustrating a shape of the locking member (left side) according to the exemplary embodiment.
Figure 9:
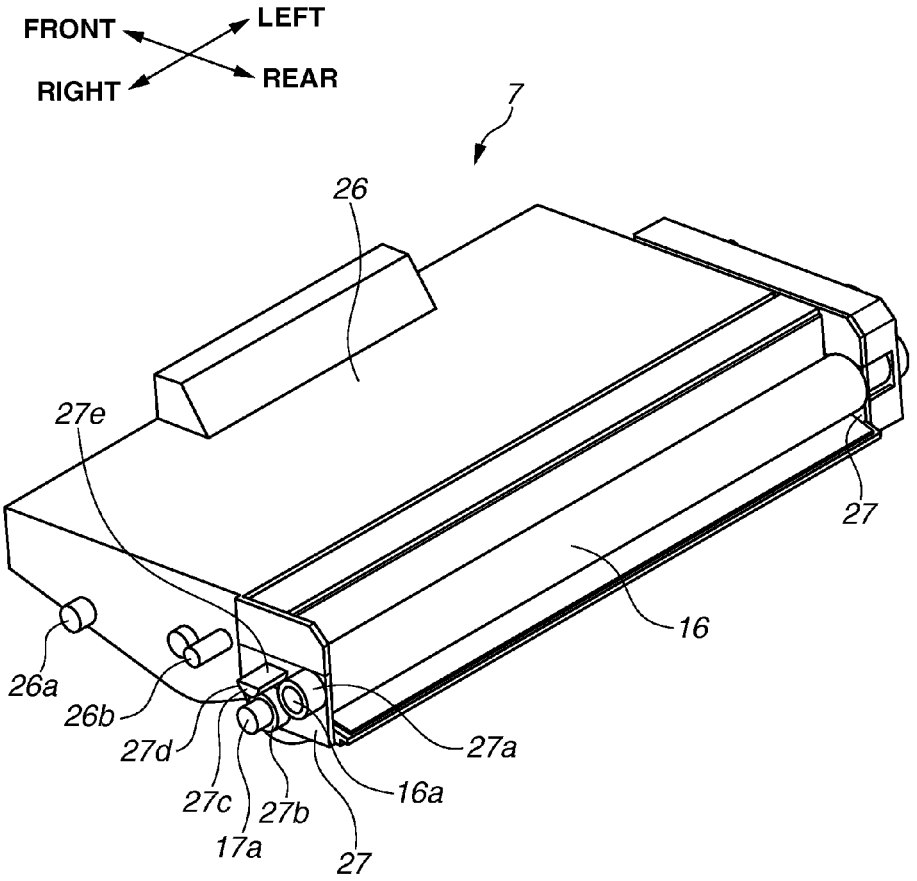
FIG. 9 is a side view illustrating a configuration of a developing cartridge according to the exemplary embodiment.

The process cartridge 5 according to the present invention will be described referring to FIGS. 3 to 9. FIG. 3 is a perspective view illustrating a configuration of the photosensitive cartridge. FIG. 4 is a perspective view illustrating a configuration of a pressing member. FIG. 5 is a perspective view illustrating the configuration of the pressing member. FIG. 6 is a side view illustrating the configuration of a locking member. FIG. 7 is a perspective view illustrating a shape of the locking member (right side). FIG. 8 is a perspective view illustrating a shape of the locking member (left side). FIG. 9 is a side view illustrating a configuration of the developing cartridge.

As described above, the process cartridge 5 includes the photosensitive cartridge 6 and the developing cartridge 7. The developing cartridge 7 is attachable to/detachable from the photosensitive cartridge 6.

The photosensitive cartridge 6 will be described. As illustrated in FIG. 3, a drum container 23 that is a frame of the photosensitive cartridge 6 rotatably supports the photosensitive drum 13. The developing cartridge 7 is attached to an attachment unit 23*a* of the drum container 23 as illustrated in FIG. 9. Positioning units 23*b* are each arranged on a left side and a right side of the drum container 23. The developing cartridge 7 is positioned with respect to the photosensitive cartridge 6 by the positioning units 23*b*. Pressing members 24 are each arranged on a front left side and a front right side of the drum container 23. As illustrated in FIG. 4, the pressing member 24 includes a shaft 24*a*. As illustrated in FIG. 3, the shaft 24*a* is fitted to a bearing 23*c* of the drum container 23 to be rotatably supported. As illustrated in FIG. 5, an urging member 31, such as a coil spring, is provided between the drum container 23 and the pressing member 24, and thus the pressing member 24 is urged in a direction of an arrow A illustrated in FIG. 5. When the developing cartridge 7 is attached to the photosensitive cartridge 6, the pressing member 24 presses the developing cartridge 7 from front to rear, and the developing roller 16 comes into contact with the photosensitive drum 13.

As illustrated in FIG. 3, a locking member 25 is movably disposed on a right side of the drum container 23. The locking member 25 is made of a conductive resin material. As illustrated in FIG. 7, the locking member 25 includes a rotating shaft 25*a*. The rotating shaft 25*a* is fitted to a rotational hole 23*d* provided to the drum container 23 to be rotatably supported. A rotational center line of the locking member 25 is arranged so as to be on the same axis as a rotational center line of the supply roller 17 of the developing cartridge 7 when the developing cartridge 7 is attached to the photosensitive cartridge 6. A lever 25*b* of the locking member 25 comes into contact with a leaf-spring shaped lever urging unit 23*e* provided to the drum container 23 so as to be urged in a direction of an arrow B illustrated in FIG. 3. A regulation unit 25*g* is also provided to the locking member 25. The regulation unit 25*g* corresponds to a regulation hole 23*f* of the drum container 23, and comes in to contact with a regulation surface 23*g* of the regulation hole 23*f* to regulate rotation of the locking member 25 in such a manner that the locking member 25 does not rotate more than necessary in the direction of the arrow B.

As illustrated in FIG. 7, a force reception unit 25*c* is provided to the lever 25*b*. A first abutment unit 25*d* is provided on a rear surface of the force reception unit 25*c*. The locking member 25 also includes a locking unit 25*e*, a slope 25*f*, and an operating unit 25*h*. As illustrated in FIG. 8, a second abutment unit 25*i* is further provided to the locking member 25. The second abutment unit 25*i* includes an abutment circular arc unit 25*j* and a cutout portion 25*k*. An operation of the locking member 25 and operations of the respective units will be described in detail below.

According to the present exemplary embodiment, the leaf-spring shape is provided to the drum container 23 to form the lever urging unit 23*e*. However, the present invention is not limited to such an arrangement. For example, an urging shape may be provided on the locking member 25 side. Alternatively, an urging member may be provided between the drum container 23 and the locking member 25.

[Detailed Configuration of Developing Cartridge]

The developing cartridge 7 will be described. As illustrated in FIG. 9, developer bearing units 27 are each arranged on a left side and a right side of a developer container 26 of the developing cartridge 7. The developer bearing units 27 includes a developing roller bearing unit 27*a* and a supply roller bearing unit 27*b*. Developing roller shafts 16*a* provided at both ends of the developing roller 16 are fitted to the developing roller bearing unit 27*a* to rotatably support the developing roller 16. Similarly, the developer bearing units 27 rotatably support the supply roller 17.

When the developing cartridge 7 is attached to the photosensitive cartridge 6, an outer peripheral surface of the developing roller bearing unit 27*a* is fitted to the positioning unit 23*b* of the photosensitive cartridge 6 as illustrated in FIG. 3. A second contact unit 17*a* is provided to the supply roller 17. The second contact unit 17*a* is a metal shaft, and an outer peripheral surface thereof is exposed. Pressed units 26*a* are each arranged on a front left and a front right side of the developer container 26. As illustrated in FIG. 5, when the developing cartridge 7 is attached to the photosensitive cartridge 6, the pressed units 26*a* are pressed by the pressing members 24 of the photosensitive cartridge 6.

Only the right pressed unit 26*a* is illustrated in FIG. 9. However, a pressed unit 26*a* not illustrated is also provided on a left side.

A locked unit 27*c* is provided to the right developer bearing unit 27. The locked unit 27*c* includes a locked circular arc unit 27*d* and a locked surface 27*e*. An operated unit 26*b* is provided to the developer container 26. Operations of the locked unit 27*c* and the operated unit 26*b* and an attaching/detaching operation of the developing cartridge 7 to/from the photosensitive cartridge 6 will be described in detail below.

[Attaching Operation of Developing Cartridge]

Figure 1:
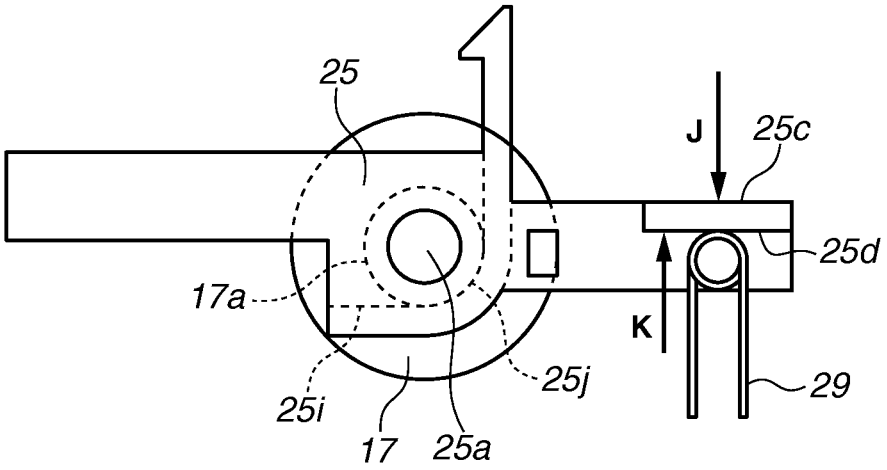
FIG. 1 is a side view illustrating a configuration of a locking member according to an exemplary embodiment.
Figure 10:
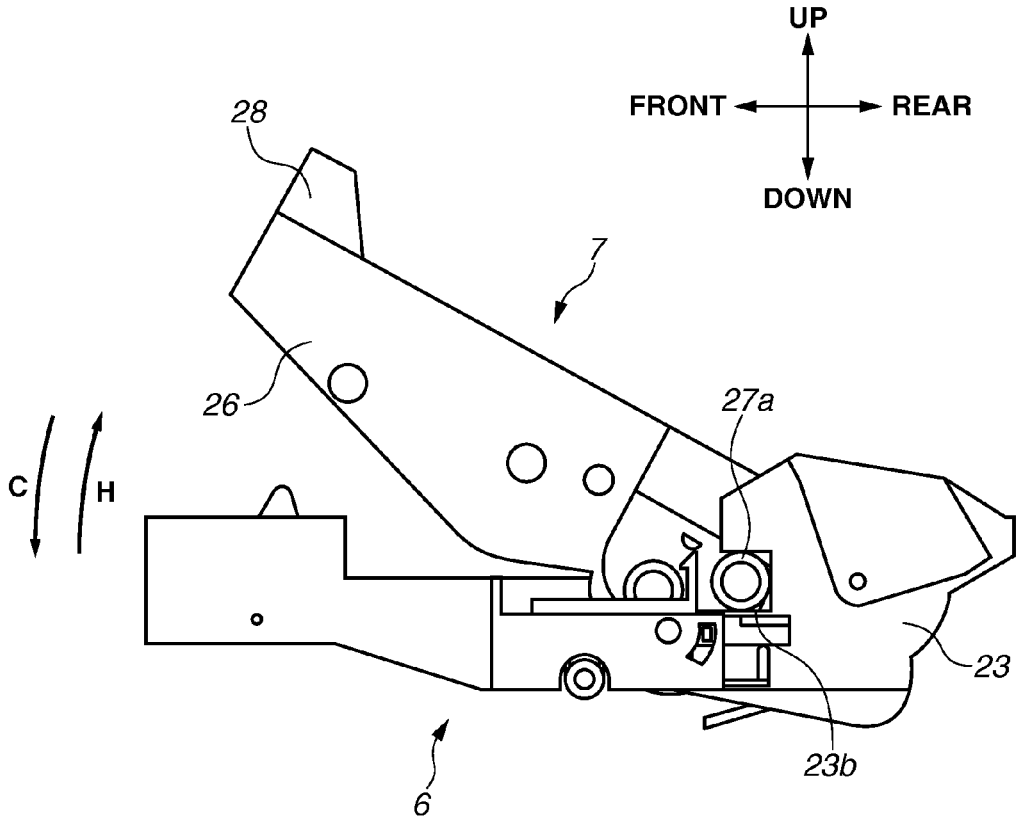
FIG. 10 is a side view illustrating an attaching/detaching operation of the developing cartridge to/from the photosensitive cartridge according to the exemplary embodiment.
Figure 11A:
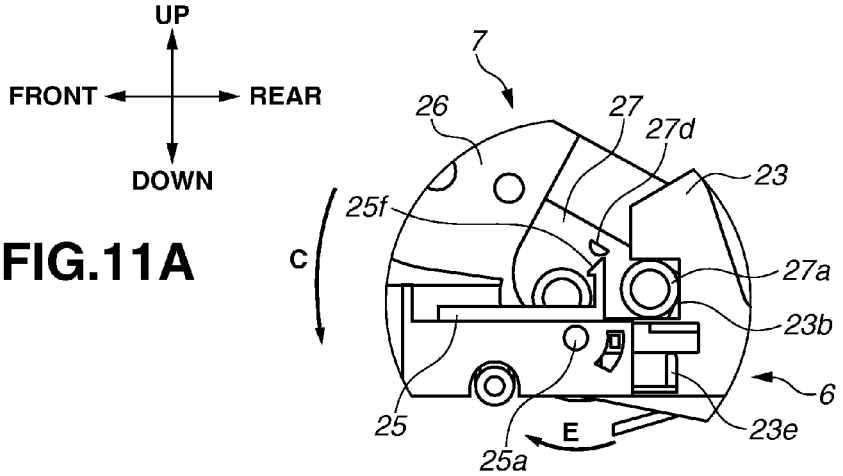
FIGS. 11A to 11C are diagrams illustrating operations of the locking member according to the exemplary embodiment.
Figure 11B:
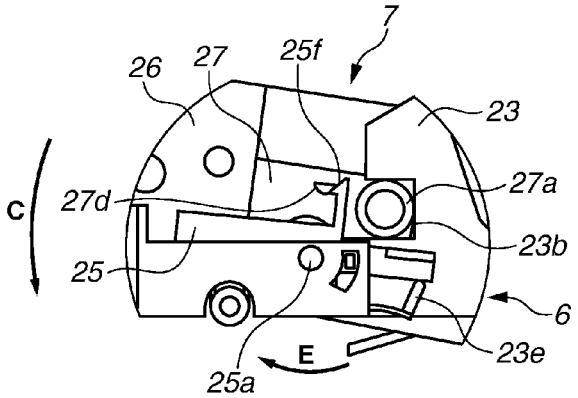
Figure 11C:
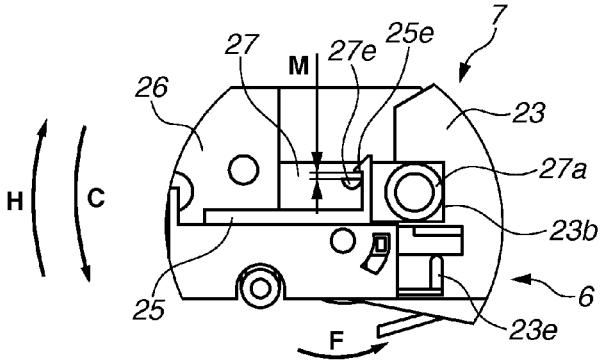
Figure 12:
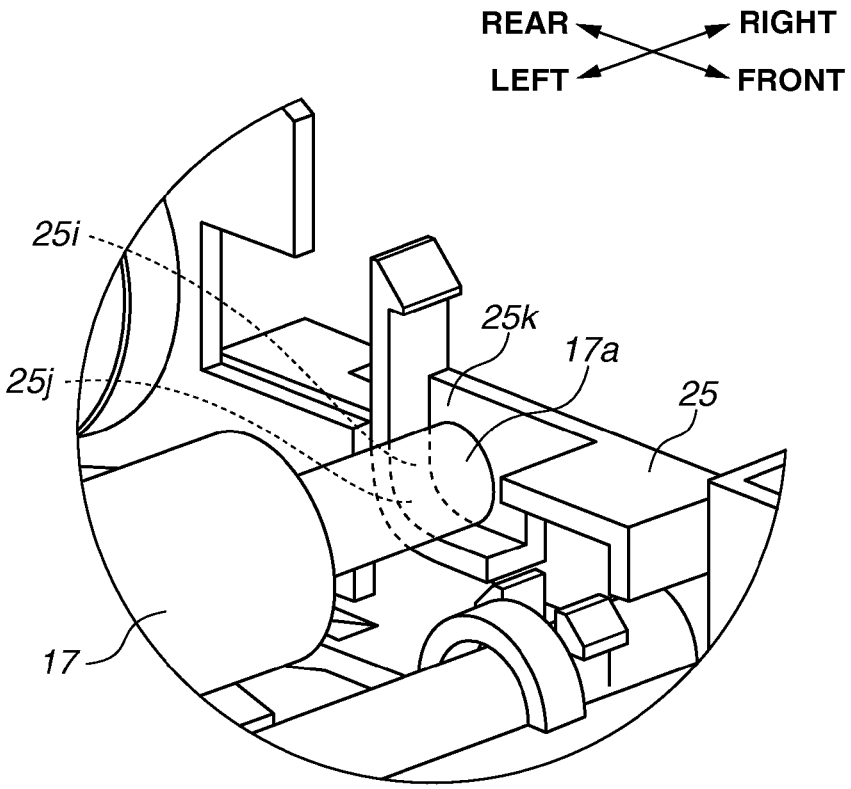
FIG. 12 is a perspective view illustrating a contact state between the locking member and a second contact unit according to the exemplary embodiment.
Figure 13:
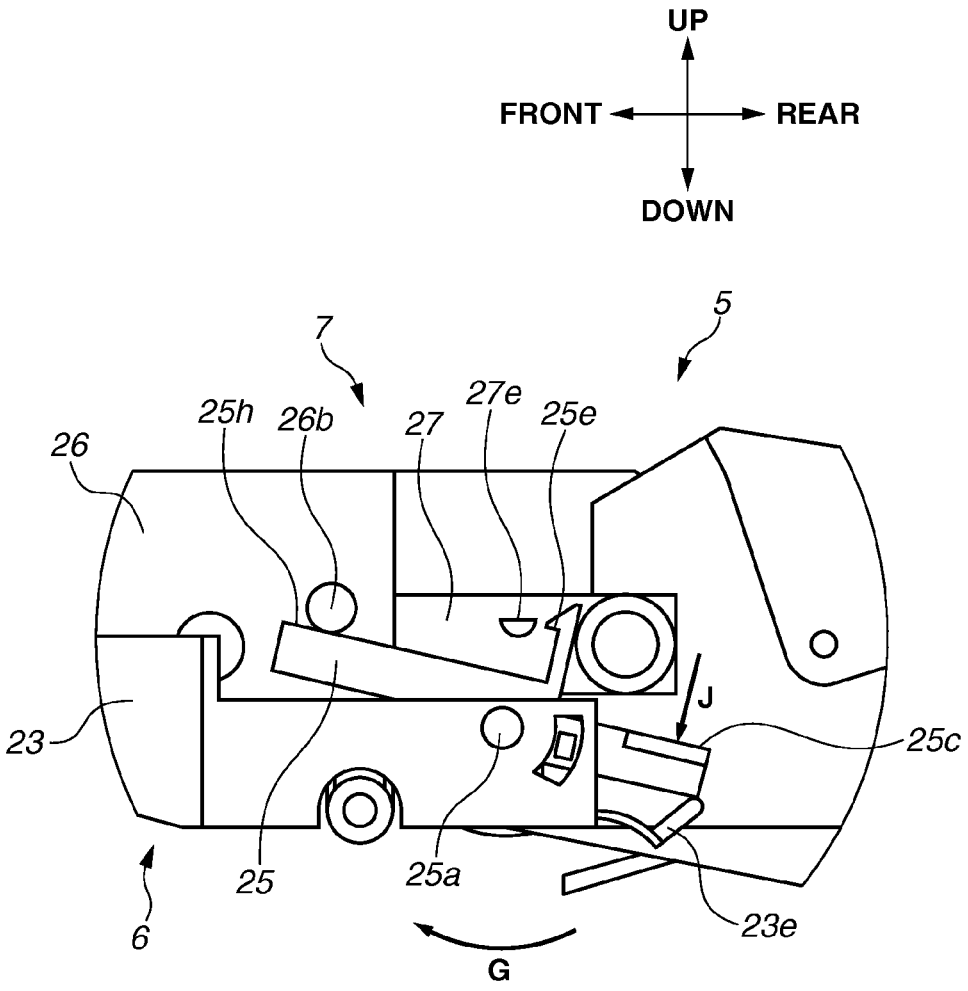
FIG. 13 is a side view illustrating a releasing operation of the locking member according to the exemplary embodiment.

Referring to FIGS. 1, and 10 to 13, the attaching/detaching operation of the developing cartridge 7 to/from the photosensitive cartridge 6 and attaching of the process cartridge 5 to the image forming apparatus 1 that are features of the present exemplary embodiment will be described. FIG. 1 is a side view illustrating the configuration of the locking member 25. FIG. 10 is a side view illustrating the attaching/detaching operation of the developing cartridge 7 to/from the photosensitive cartridge 6. FIGS. 11A to 11C are diagrams illustrating operations of the locking member 25. FIG. 12 is a perspective view illustrating a contact state between the locking member 25 and the second contact unit 17*a*. FIG. 13 is a side view illustrating a releasing operation of the locking member 25.

The attaching/detaching operation of the developing cartridge 7 to/from the photosensitive cartridge will be described. A procedure of attaching the developing cartridge 7 performed by the user is as follows.

As illustrated in FIG. 10, a grip 28 of the developing cartridge 7 is held to fit the developing roller bearing unit 27*a* to the positioning unit 23*b*. Then, the developing cartridge 7 is rotated around the developing roller bearing unit 27*a* in a direction of an arrow C illustrated in FIG. 10.

At this time, as illustrated in FIG. 11A, the locked circular arc unit 27*d* of the developer bearing unit 27 comes into contact with the slope 25*f* of the locking member 25. Thus, the locking member 25 rotates around the rotating shaft 25*a* in a direction of an arrow E illustrated in FIG. 11A, and moves to a position illustrated in FIG. 11B. The position of the locking member 25 at this time is referred to as a permission position.

When the rotation of the developing cartridge 7 in the direction of the arrow C is continued from the state illustrated in FIG. 11B, the locked circular arc unit 27*d* passes the slope 25*f* and, by an urging force of the lever urging unit 23*e*, the locking member 25 is rotated in a direction of an arrow F as illustrated in FIG. 11C. When the developing cartridge 7 is rotated more in the direction of the arrow C, the second contact unit 17*a* of the developing cartridge 7 comes into contact with the second abutment unit 25*i* of the locking member 25 as illustrated in FIG. 12. At this time, an outer peripheral surface of the second contact unit 17*a* and the abutment circular arc unit 25*j* of the second abutment unit 25*i* have certain contact pressure by self-weight of the developing cartridge 7. The attaching of the developing cartridge 7 is completed through the above-described procedure.

At the completion time of the attaching operation of the developing cartridge 7, the locked surface 27*e* and the locking unit 25*e* are arranged with a gap M as illustrated in FIG. 11C. When the developing cartridge 7 is rotated in a detaching direction (a direction of an arrow H illustrated in FIG. 11C) from the photosensitive cartridge 6 in this state, the locked surface 27*e* and the locking unit 25*e* interfere with each other. Accordingly, detachment of the developing cartridge 7 from the photosensitive cartridge 6 is disabled. More specifically, the developing cartridge 7 is locked to the photosensitive cartridge 6 by the locking member 25. A position of the locking member 25 at this time is referred to as a regulation position.

As described above, the cutout portion 25*k* is provided to the front part of the second abutment unit 25*i*. If the second abutment unit 25*i* is cylindrical in shape, during the attaching operation of the developing cartridge 7 to the photosensitive cartridge 6, the cylindrical shape and the second contact unit 17*a* of the developing cartridge 7 interfere with each other. However, within an interfering range of the second abutment unit 25*i*, the cylindrical shape is cut out. Therefore, in an attaching locus of the developing cartridge 7 to the photosensitive cartridge 6, the locking member 25 and the second contact unit 17*a* are prevented from interfering with each other. In other words, since the second contact unit 17*a* and the second abutment unit 25*i* can be contacted with each other only by an operation of dropping the developing cartridge 7 from above, the attachment of the developing cartridge 7 to the photosensitive cartridge 6 can be facilitated.

[Detaching Operation of Developing Cartridge]

A detaching operation of the developing cartridge 7 from the photosensitive cartridge 6 will be described. A procedure of detaching the developing cartridge 7 performed by the user is as follows.

First, as illustrated in FIG. 13, the user presses the force reception unit 25*c* of the locking member 25 in a direction of an arrow J illustrated in FIG. 1. Accordingly, the locking member 25 rotates in a direction of an arrow G illustrated in FIG. 13. At this time, an engagement between the locked surface 27*e* of the developer bearing unit 27 and the locking unit 25*e* of the locking member 25 is released, and simultaneously the operating unit 25*h* of the locking member 25 presses the operated unit 26*b* of the developer container 26. A position of the locking member 25 at this time is also the permission position. Thus, the developing cartridge 7 is lifted by the locking member 25. From this state, as illustrated in FIG. 10, the user holds the grip 28 to rotate the developing cartridge 7 around the developer roller shaft bearing unit 27*a* in a direction of an arrow H illustrated in FIG. 11C. The developer roller shaft bearing unit 27*a* is then detached from the positioning unit 23*b*. Through the above-described procedure, the detaching of the developing cartridge 7 is completed.

With the configuration in which the developing cartridge 7 is lifted when the user presses the force reception unit 25*c* of the locking member 25, the user can recognize in which direction the developing cartridge 7 should be moved to detach the developing cartridge 7 from the photosensitive cartridge 6. In other words, the detaching operation of the developing cartridge 7 from the photosensitive cartridge 6 is facilitated.

As illustrated in FIG. 1, in the attached state of the process cartridge 5 to the image forming apparatus 1, a first contact unit 29 that is a main body contact member of the image forming apparatus 1 comes into contact with the first abutment unit 25*d* of the locking member 25. It is desirable that a certain contact pressure is provided to the first abutment unit 25*d* and the first contact unit 29. The first contact unit 29 applies a predetermined bias from the image forming apparatus 1 to the process cartridge 5. Since the locking member 25 is made of the conductive material as described above, the bias applied from the first contact unit 29 passes through the first abutment unit 25*d* to flow to the locking member 25. Then, the bias reaches the second contact unit 17*a* from the second abutment unit 25*i*. As a result, the first contact unit 29 and the second contact unit 17*a* can be electrically connected via the locking member 25, and the bias can be applied from the image forming apparatus 1 to the supply roller 17.

A direction in which the first abutment unit 25*d* receives contact pressure from the first contact unit 29 (a direction of an arrow K illustrated in FIG. 1) and a direction in which the force reception unit 25*c* is pressed by the user (the direction of the arrow J illustrated in FIG. 1) are opposite each other. With this configuration, in the attached state of the process cartridge 5 to the image forming apparatus 1, the locking member 25 is urged in a direction opposite a releasing direction. More specifically, the locking member 25 is not released, and the developing cartridge 7 is thus prevented from falling off from the photosensitive cartridge 6 in the apparatus main body 2.

As described above, according to the present exemplary embodiment, the locking member further has a function for electrically connecting the main body contact member and the developing cartridge by coming into contact with the main body contact member, thereby the number of components and costs can be reduced.

According to the present exemplary embodiment, the locking member is a member for applying the bias to the supply roller, but not limited to such a configuration. Alternatively, the bias can be applied to the developing roller of the developing cartridge and other members by changing the arrangement of the locking member.

Alternatively, a configuration in which a locking member is provided on the developing cartridge side while a locked unit is provided on the photosensitive cartridge side may be applicable.

Further, the photosensitive cartridge may be set to be attachable to/detachable from the developing cartridge and a locking member may be provided to the developer container, so that a bias can be applied to the photosensitive drum of the photosensitive cartridge, the charging member, and the other member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-008933 filed Jan. 21, 2014, which is hereby incorporated by reference herein in its entirety.

What is claimed is:

1. A photosensitive cartridge attachable to/detachable from a main body of an image forming apparatus, the photosensitive cartridge comprising:

a photosensitive member;

an attachment unit configured to removably attach a developing cartridge including a developing member that develops a latent image formed on the photosensitive member to the photosensitive cartridge; and a locking member configured to prevent disengaging of the developing cartridge from the attachment unit when the developing cartridge is attached to the attachment unit, wherein, when the photosensitive cartridge to which the developing cartridge has been attached is attached to the main body of the image forming apparatus, the locking member comes into contact with a main body contact member provided to the main body, and electrically connects the main body contact member and the developing cartridge.

2. The photosensitive cartridge according to claim 1, wherein the locking member is movable between a regulation position of preventing the disengaging of the developing cartridge from the attachment unit and a permission position of permitting attaching/detaching of the developing cartridge to/from the attachment unit, and wherein the photosensitive cartridge includes an urging unit configured to urge the locking member to move from the permission position to the regulation position.

3. The photosensitive cartridge according to claim 2, further comprising a frame configured to rotatably support the photosensitive member, wherein the urging unit is provided to the frame.

4. The photosensitive cartridge according to claim 1, wherein the locking member is made of a conductive resin material.

5. The photosensitive cartridge according to claim 1, further comprising a pressing member configured to press the developing member toward the photosensitive member.

6. The photosensitive cartridge according to claim 1, wherein the locking member is movable between a regulation position of preventing the disengaging of the developing cartridge from the attachment unit and a permission position of permitting attaching/detaching of the developing cartridge to/from the attachment unit, and wherein the locking member moves from the regulation position to the permission position by coming into contact with the developing cartridge when the developing cartridge is attached to the attachment unit.

7. The photosensitive cartridge according to claim 1, wherein the locking member is movable between a regulation position of preventing the disengaging of the developing cartridge from the attachment unit and a permission position of permitting attaching/detaching of the developing cartridge to/from the attachment unit, and wherein the locking member includes a force reception unit that receives a force for moving the locking member from the regulation position to the permission position.

8. The photosensitive cartridge according to claim 1, wherein the developing cartridge includes a roller, wherein the locking member includes a first abutment unit capable of coming into contact with the main body contact member and a second abutment unit capable of coming into contact with a shaft of the roller, and wherein the locking member electrically connects the main body contact member and the roller.

9. A process cartridge attachable to/detachable from a main body of an image forming apparatus, the process cartridge comprising:

a developing cartridge including a developing member that develops a latent image formed on a photosensitive member;

a photosensitive cartridge including the photosensitive member and an attachment unit that removably attaches the developing cartridge to the photosensitive cartridge; and a locking member configured to prevent disengaging of the developing cartridge from the attachment unit when the developing cartridge is attached to the attachment unit, wherein, when the process cartridge is attached to the main body of the image forming apparatus, the locking member comes into contact with a main body contact member provided to the main body, and electrically connects the main body contact member and the developing cartridge.

10. The process cartridge according to claim 9, wherein the locking member is movable between a regulation position of preventing the disengaging of the developing cartridge from the attachment unit and a permission position of permitting attaching/detaching of the developing cartridge to/from the attachment unit, and wherein the photosensitive cartridge includes an urging unit configured to urge the locking member to move from the permission position to the regulation position.

11. The process cartridge according to claim 10, further comprising a frame configured to rotatably support the photosensitive member, wherein the urging unit is provided to the frame.

12. The process cartridge according to claim 9, wherein the locking member is made of a conductive resin material.

13. The process cartridge according to claim 9, further comprising a pressing member configured to press the developing member toward the photosensitive member.

14. The process cartridge according to claim 9, wherein the locking member is movable between a regulation position of preventing the disengaging of the developing cartridge from the attachment unit and a permission position of permitting attaching/detaching of the developing cartridge to/from the attachment unit, unit; and wherein the locking member moves from the regulation position to the permission position by coming into contact with the developing cartridge when the developing cartridge is attached to the attachment unit.

15. The process cartridge according to claim 9, wherein the locking member is movable between a regulation position of preventing the disengaging of the developing cartridge from the attachment unit and a permission position of permitting attaching/detaching of the developing cartridge to/from the attachment unit, and wherein the locking member includes a force reception unit that receives a force for moving the locking member from the regulation position to the permission position.

16. The process cartridge according to claim 9, wherein the developing cartridge includes a roller, wherein the locking member includes a first abutment unit capable of coming into contact with the main body contact member and a second abutment unit capable of coming into contact with a shaft of the roller, and wherein the locking member electrically connects the main body contact member and the roller.

17. An image forming apparatus for forming an image on a recording medium, the image forming apparatus comprising:

a developing cartridge including a developing member that develops a latent image formed on a photosensitive member;

a photosensitive cartridge including the photosensitive member and an attachment unit that removably attaches the developing cartridge to the photosensitive cartridge;

a locking member configured to prevent disengaging of the developing cartridge from the attachment unit when the developing cartridge is attached to the attachment unit;

an apparatus main body to which the photosensitive cartridge is attached; and a main body contact member provided to the apparatus main body, wherein, when the photosensitive cartridge to which the developing cartridge has been attached is attached to the apparatus main body, the locking member comes into contact with the main body contact member, and electrically connects the main body contact member and the developing cartridge.

18. The image forming apparatus according to claim 17, wherein the locking member is movable between a regulation position of preventing the disengaging of the developing cartridge from the attachment unit and a permission position of permitting attaching/detaching of the developing cartridge to/from the attachment unit, and wherein the photosensitive cartridge includes an urging unit configured to urge the locking member to move from the permission position to the regulation position.

19. The image forming apparatus according to claim 17, further comprising a frame configured to rotatably support the photosensitive member, wherein the urging unit is provided to the frame.

20. A developing cartridge attachable to/detachable from a photosensitive cartridge including a photosensitive member and an attachment unit, the developing cartridge comprising:

a developing member configured to develop a latent image formed on the photosensitive member; and a locking member configured to prevent disengaging of the developing cartridge from the attachment unit when the developing cartridge is attached to the attachment unit, wherein, when the developing cartridge in a state where the photosensitive cartridge has been attached to the developing cartridge is attached to a main body of an image forming apparatus, the locking member comes into contact with a main body contact member provided to the main body, and electrically connects the main body contact member and the developing cartridge.

* * * * *